US008720010B2

(12) United States Patent
Forster

(10) Patent No.: US 8,720,010 B2
(45) Date of Patent: May 13, 2014

(54) DAMPING DEVICE, FURNITURE HINGE AND FURNITURE

(75) Inventor: Kurt Forster, Wangen (DE)

(73) Assignee: Grass GmbH, Hochst (AT)

( * ) Notice: Subject to any disclaimer, the term of this patent is extended or adjusted under 35 U.S.C. 154(b) by 0 days.

(21) Appl. No.: 13/530,252

(22) Filed: Jun. 22, 2012

(65) Prior Publication Data

US 2013/0000075 A1 Jan. 3, 2013

(30) Foreign Application Priority Data

Jun. 30, 2011 (DE) ..... 20 2011 103 288 U

(51) Int. Cl.
*E05F 1/08* (2006.01)
*E05F 5/02* (2006.01)

(52) U.S. Cl.
USPC ..... 16/286; 16/54

(58) Field of Classification Search
USPC ..... 16/286, 287, 288, 54, 56, 366, 370, 16/371, 354; 188/282.1, 282.2, 381, 266, 188/283, 280, 281
See application file for complete search history.

(56) References Cited

U.S. PATENT DOCUMENTS

| | | | | |
|---|---|---|---|---|
| 4,166,522 | A * | 9/1979 | Bourcier de Carbon | 188/287 |
| 5,104,098 | A * | 4/1992 | Kaneko | 267/64.11 |
| 6,553,617 | B1 * | 4/2003 | Salice | 16/85 |
| 7,228,949 | B2 * | 6/2007 | Namiki et al. | 188/381 |
| 7,234,569 | B2 * | 6/2007 | Salice | 188/130 |
| 7,600,295 | B2 * | 10/2009 | Zimmer | 16/286 |
| 7,669,285 | B2 * | 3/2010 | Gallasch et al. | 16/286 |
| 7,861,371 | B2 * | 1/2011 | Kim | 16/85 |
| 2003/0200625 | A1 * | 10/2003 | Zimmer | 16/306 |
| 2005/0015927 | A1 * | 1/2005 | Kropf | 16/286 |
| 2008/0109987 | A1 * | 5/2008 | Chen et al. | 16/68 |
| 2009/0083939 | A1 | 4/2009 | Wu | |
| 2012/0085607 | A1 * | 4/2012 | Weber | 188/282.1 |

FOREIGN PATENT DOCUMENTS

GB 2 476 832 A 7/2011

OTHER PUBLICATIONS

German Search Report dated Feb. 17, 2012.

* cited by examiner

*Primary Examiner* — Chuck Mah
(74) *Attorney, Agent, or Firm* — Burr & Brown, PLLC

(57) ABSTRACT

A damping device for damping a relative movement of device parts of a device for pivoting and/or displacing a furniture part guided movably on a furniture body is proposed, the damping device comprising a damper housing with an inner volume and an inner part accommodated in the inner volume, the damper housing and the inner part executing a relative movement during a damping action, so that, during the relative movement, wall portions delimiting the inner volume and an at least essentially cylindrical portion of the inner part can be moved past and opposite one another. According to the invention, the wall portions have an essentially hollow-cylindrical basic shape, guide means portions projecting in regions into the hollow-cylindrical basic shape, which guide means portions are in bearing contact against the cylindrical portion of the inner part during the relative movement.

13 Claims, 4 Drawing Sheets

DAMPING DEVICE, FURNITURE HINGE AND FURNITURE

CROSS REFERENCE TO RELATED APPLICATION

This application claims the benefit under 35 USC §119(a)-(d) of German Application No. 20 2011 103 288.8 filed Jun. 30, 2011, the entirety of which is incorporated herein by reference.

FIELD OF THE INVENTION

The invention relates to a damping device, furniture hinge and furniture.

BACKGROUND OF THE INVENTION

In the furniture sector, damping devices for the damping of opening and/or closing movements of furniture parts, such as doors, flaps, pull-out extensions, drawers and the like, which are guided movably on a body are known.

Damping is implemented, for example, in that a relative movement of device parts of a guide device is damped by means of the damping device, the guide device being designed for pivoting and/or displacing the furniture part guided movably on the body, so that, when the furniture part is moved, the device parts experience an accompanying movement.

The damping device is configured, for example, as a component present separately on the guide device. The damping device preferably comprises, for example, a damper housing with an inner volume and an inner part accommodated in the inner volume at least partially or to a different extent throughout the time of a damping action, the damper housing and the inner part executing a relative movement during a damping action. The inner volume is delimited by internal wall portions of the damper housing, an at least essentially cylindrical portion of the inner part and the wall portions being capable, during the relative movement, of being moved past and opposite one another.

In the known damping devices or furniture hinges, performance fluctuations or a damping behavior exceeding acceptable limits or problematic damper coordinations may occur because the inner part is not guided optimally in the damper housing.

SUMMARY OF THE INVENTION

The object of the present invention is, in arrangements mentioned in the introduction, to rule out or to minimize the disadvantages explained above.

The invention proceeds from a damping device for damping a relative movement of device parts of a device for pivoting and/or displacing a furniture part guided movably on a furniture body, the damping device comprising a damper housing with an inner volume and an inner part accommodated in the inner volume, the damper housing and the inner part executing a relative movement during a damping action, so that, during the relative movement, wall portions delimiting the inner volume and an at least essentially cylindrical portion of the inner part can be moved past and opposite one another. The invention is directed particularly at a device for a furniture hinge.

A first aspect of the present invention is to be seen in that the wall portions have an essentially hollow-cylindrical basic shape, guide means portions projecting in regions into the hollow-cylindrical basic shape, which guide means portions are in bearing contact against the at least essentially cylindrical portion of the inner part during the relative movement. Thus, exact and smooth guidance of the inner part in the damper housing can take place. In particular, the inner part or its longitudinal axis is guided such that the relative movement takes place along an ideal axis of movement, in particular without even a slight inclination or without an offset of an axis of symmetry of, for example, a centric longitudinal axis of the inner part with respect to an axis of symmetry of the hollow-cylindrical basic shape of the damper housing, for example a centric longitudinal axis of the damper housing. In particular, guidance takes place via the guide means portions over a substantial length of the relative movement of those portions of wall portions and the inner part which can be brought to into bearing contact with one another.

Preferably, between the hollow-cylindrical basic shape and the cylindrical part of the inner part, an annular gap with a constant or circumferentially virtually identical annular gap width is formed, with the exception of the interrupted portions of the annular gap or the interruptions caused by the guide means portions bearing against the inner part on the outside. According to the invention, in all phases of a damping action, identical ideal guidance of the inner part in relation to the damper housing takes place. Moreover, sliding friction between the portions capable of being brought into bearing contact can be influenced or minimized by the type of coordination between the guide means portions and the outside of the inner part.

Hitherto occurring performance fluctuations in damper coordination, which have no clearly controllable damping features or have unforeseeable damping features, can be avoided according to the invention.

In particular, a uniform gap region or a gap region extending over the entire respective length of the damping device can be formed between wall portions of the damper housing and the inner part. Thus, centric guidance of the inner part in the hollow-cylindrical inner volume can be achieved. In terms of a symmetrical arrangement, an offset of the inner part in the radial direction to the cylindrical portion of the inner part with respect to the hollow-cylindrical wall portions is ruled out, since such an offset is prevented in all directions for the guide means portions.

A further essential aspect of the present invention is that the wall portions have an essentially polygonal basic shape, guide means portions being formed between corners of the polygonal basic shape and being in bearing contact against the cylindrical portion of the inner part of the relative movement. The advantages already mentioned above can consequently be achieved. In particular, here too, centric guidance of the inner part in the hollow-cylindrical inner volume can be implemented. Bearing contact between the corners takes place, in particular, in the middle, in particular straight portion between two corners.

The polygonal basic shape refers particularly to regular polygons in the geometric sense or in the surface theory sense, for example pentagons, hexagons, heptagons or octagons, etc., although other polygons, for example a triangle, are not ruled out.

Further, according to an advantageous embodiment, it is proposed that the guide means portions be present circumferentially at least two locations on the essentially hollow-cylindrical basic shape. In particular, the two guide means portions lie opposite one another diametrically with respect to a centric longitudinal axis of the inner volume or offset somewhat thereto. Thus, in a simple way, advantageous guidance of the inner part in the damper housing or in the inner volume of the damper housing can be achieved.

Moreover, it is advantageous that the guide means portions have at least two elevations running in the longitudinal direction of the essentially hollow-cylindrical basic shape. An elevation preferably extends over the entire length of the hollow-cylindrical basic shape of the wall portions of the interior of the damper housing, at least over essential portions which are in bearing contact against the outside of the inner part during the relative movement or damper movement and its return movement. Comparatively short interruptions in the longitudinal direction are acceptable or present no problems for the guidance function of the guide means portions.

The longitudinal direction runs in the direction of a longitudinal axis which corresponds, in particular, to the centric axis of the inner volume.

The two elevations may differ from one another, but advantageously are of the same type, in particular are designed identically, preferably so as to be narrow or continuously strip-shaped. A guide means portion has, transversely to its longitudinal extent or transversely to the longitudinal direction of the damper housing or in the circumferential direction of the damper housing designed as a hollow-cylindrical part, only a comparatively small dimension, for example extending over a few degrees of angle, preferably between approximately 2 and 10 degrees of angle.

In an advantageous modification of the subject of the invention, the guide means portions have two elevations which are assigned to one another and which are spaced apart by a region of the inner volume. The at least two elevations are preferably assigned, for example, in pairs to one another, so that, for example with exactly two elevations, the inner part can be supported or is guided on opposite portions on the outside and is positioned with an exactly stipulated setting in relation to the damper housing or to the wall portions.

It is also advantageous that the guide means portions have two elevations which are positioned at least approximately opposite one another. Thus, the inner part can be positioned in the inner volume especially simply, with its entire outside regions contactless in relation to the wall portions, equidistantly or with a gap width dimension in relation to the wall portions. In principle, exactly two guide means portions are possible or a multiple of in each case two opposite guide means portions is possible.

Furthermore, it is advantageous that a plurality of guide means portions are uniformly spaced apart from one another circumferentially on the essentially hollow-cylindrical basic shape. In particular, the guide means portions are present, spaced uniformly apart from one another in the circumferential direction. Especially preferably, exactly three guide means portions in each case offset to one another in the circumferential direction by 120 degrees of angle are formed.

It is also advantageous that the guide means portions have a plurality of elevations with respect to a longitudinal axis of the essentially hollow-cylindrical basic shape.

Further, it is advantageous that the guide means portions have at least two opposite sliding portions, against which the inner part is slidably in bearing contact during the relative movement. Consequently, regions of the guide means portions or the sliding portions can be designed in keeping with a slide mounting. The shape of the sliding portions may, where appropriate, be coordinated with the shape of the outside of the inner part, for example may have a concavely or convexly curved shape, in that case, for example, with a concave portion. The surface quality of the sliding portions may likewise be adapted, for example be configured as a smooth or polished surface.

The sliding portions afford the actual guidance of the movement of the inner part.

In a further advantageous embodiment of this subject of the invention, the guide means portions have, in a section transverse to the longitudinal axis of the essentially hollow-cylindrical basic shape, oblique flanks with a sliding portion lying between them. The flanks do not in this case come to bear against the inner part. This arrangement can be designed to be especially stable and simple, and, in particular, is configured symmetrically in a trapezoidal cross section.

Further, it is advantageous that the sliding portion is of an essentially planar configuration. Thus, linear guidance can be provided in a simple way. This embodiment is also distinguished by simple production.

In terms of wall portions which have an essentially polygonal basic shape, it is advantageous that the wall portions have an essentially regular polygonal shape.

In particular, a basic shape hexagonal in section or a hexagonal shape of the wall portions is advantageous.

Furthermore, a furniture hinge is proposed which has a damping device as defined above. Thus, the advantages explained can be achieved on a furniture hinge according to the invention.

The invention relates, moreover, to furniture with a body and with a movable furniture part, in particular with a door, flap or drawer, fastened to the body. According to the invention, a furniture hinge designed as mentioned above is present. The abovementioned advantages can consequently be achieved on such furniture which has, for example, at least one furniture hinge according to the invention.

BRIEF DESCRIPTION OF THE DRAWINGS

Further features and advantages of the invention are explained in more detail by means of the exemplary embodiments shown in the figures.

FIG. 4*a* shows a top view, FIG. 4*b* a front view, FIG. 4*c* a bottom view, FIG. 4*d* a sectional view along the line A-A in FIG. 4*b*;

FIG. 4*e* a side view corresponding to the sectional view according to FIG. 4*d;*

DETAILED DESCRIPTION OF THE INVENTION

Figure 1:
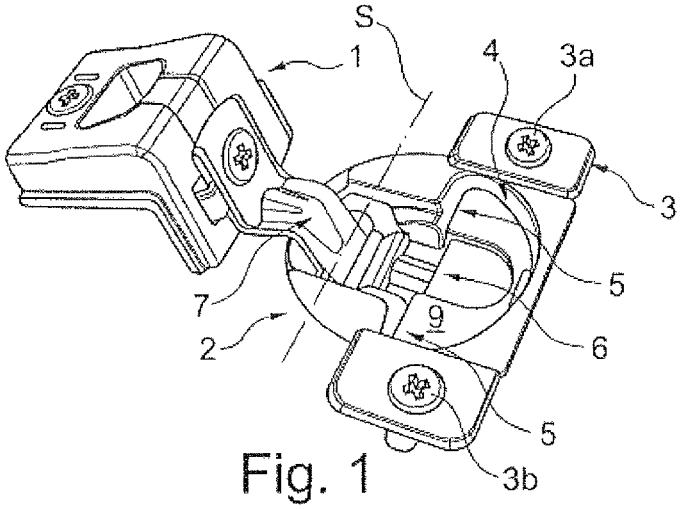
FIG. 1 shows essential components of a device for pivoting a furniture part.

FIG. 1 shows essential parts of a device for guiding or pivoting a furniture part movable in relation to a furniture body, the device being designed here as a furniture hinge. The furniture body and the furniture part are not shown, nor is a first hinge fastening part designed for attachment to the furniture body.

A hinge arm 1 of the hinge is connected to the first fastening part in the mounted state of the hinge, so that, by means of the hinge, the movable furniture part, to which a second fastening part of the hinge is fixed, can be pivoted out of a closing position closed in relation to the furniture body into an opening position open in relation to the furniture body, and back again. The hinge provides a pivot axis S with a pivot bearing (not shown), the hinge arm 1 being articulated via the pivot bearing on the second fastening part which can be secured to the movable furniture part and which comprises a hinge pot 2 with a fastening flange 3.

The position, shown in FIG. 1, of the hinge parts in relation to one another corresponds, in the mounted state of the hinge on the furniture, to a position, partially open in relation to the furniture part, of the movable furniture part.

The hinge pot 2 is inserted for mounting on the movable furniture part in a depression or receptacle, for example a blind hole, prepared in the correct position on the furniture part and is fixed in the correct position in the furniture part, via two bores present laterally with respect to the blind hole, by means of screws 3*a*, 3*b* passing through the fastening flange 3. A baseplate 9 of damping device 6 is inserted in an outwardly directed depressed region in the hinge pot 2, the baseplate 9 being adapted to the semicircular shape of an inner wall 4 of the depression of the hinge pot 2. Adjacently to the arcuate inner wall 4, as seen in a top view, two inward projections 5 arc formed in the wall of the hinge pot 2, on which the damping device 6 is in each case supported and thus held, slightly clamped, fixed in position in the hinge pot 2. On the underside, the damping device 6 is seated on a bottom surface of the depression of the hinge pot 2. The damping device 6 can therefore be inserted with a clamping action into the hinge pot 2 from above without any problems, for example by hand during the production of the hinge.

During a pivoting movement of the furniture part, with the hinge mounted, a shackle spring (not shown) takes effect, which serves, in particular, as an automatic closing mechanism and, under the action of spring force, brings the movable furniture part into a closing position swung in to the body or holds it in the closing position. Counter to this force or counter to an overall acting closing movement force or closing energy of the closing furniture part, which, where appropriate, is pushed shut vigorously by an operator, the damping device 6 acts during the closing of the furniture part and brakes the closing movement of the furniture part on the last part of its travel.

When the last part of the travel is reached during the closing movement of the movable furniture part, a bearing point 7 or bearing region on the hinge arm 1, which is fixed in position in relation to the furniture body, in this case comes into contact with part of the damping device 6 which, during the pivoting of the furniture part, is comoved spatially with the latter or with the second fastening part. The contact of the bearing point 7 takes place with a contact part of the damping device 6, the contact part being formed on a damper housing 8 of the damping device 6. The damper housing 8 is guided to and fro according to the double arrow P1 (FIG. 2) in relation to the baseplate 9 of the damping device 6 or can be displaced in a direction counter to a damping resistance, with FIGS. 1 to 4*e* showing a position of the contact part or of the damper housing 8 in which it is moved out as far as possible with respect to the baseplate 9. The damper housing 8 forms the front portion of a damper cylinder 10 which is guided displaceably on guide webs 11 of the baseplate 9.

Figure 2:
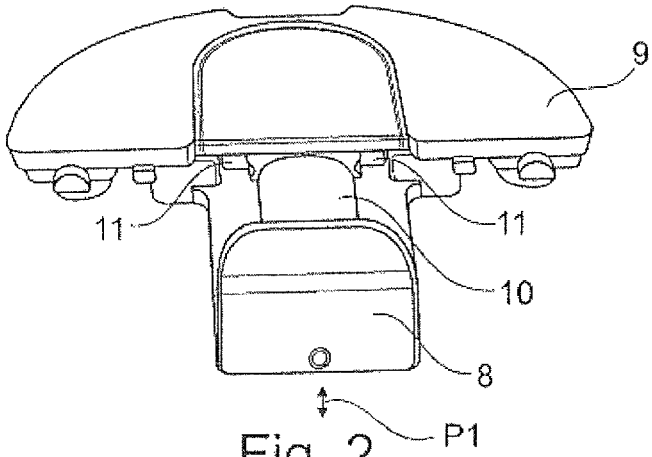
FIG. 2 shows a device part of the device according to FIG. 1.
Figure 3:
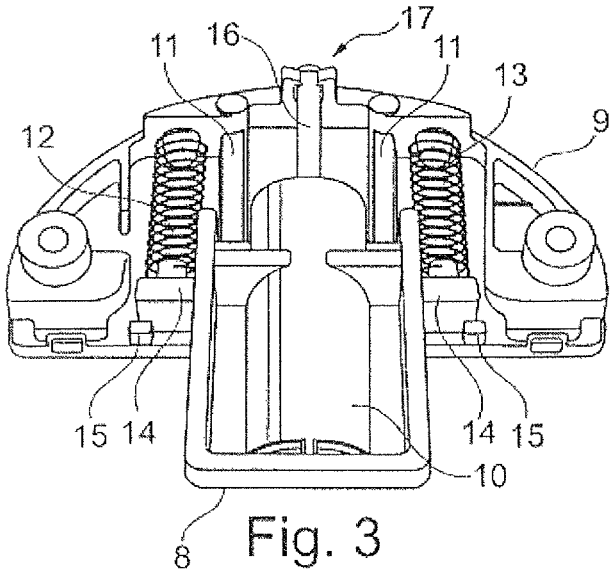
FIG. 3 shows the device part according to FIG. 2 in a bottom view.

Moreover, the damper cylinder 10 is held with respect to the baseplate 9 via springs 12, 13 in a position of readiness or in the maximum moved-out stop position according to FIGS. 1 to 4*e*, in each case noses 14 which laterally project transversely on the damper cylinder 10 pressing against mechanical stops 15 on the baseplate 9. During the damping action, the damper cylinder 10 is pressed inward out of a projecting position on the baseplate 9 in relation to the latter, along with the compression of the relatively weak springs 12, 13 which make no appreciable contribution to actual damping. In this case, a relative movement of a piston or inner part 19 engaging in an inner or hollow volume of the damper cylinder 10 takes place, as shown in FIG. 4*f*. The inner part 19, which is evident in FIGS. 4*d* and 4*f*, has adjoining it a piston rod 16 which is fixed with its free end on the baseplate 9 at a piston rod fixing 17, as shown in FIG. 2. The damper cylinder 10 and the inner part 19, together with the piston rod 16, cooperate in the manner of a piston cylinder damper or fluid damper known per se, and therefore the corresponding relations are not explained in any more detail here.

Figure 4A:
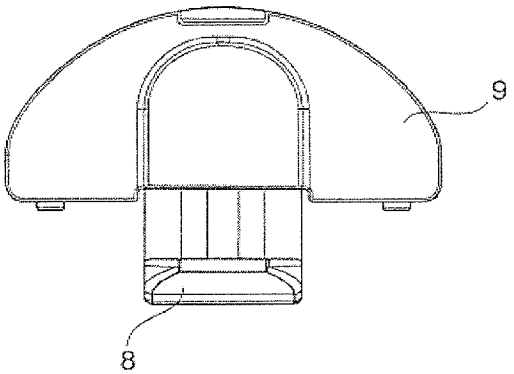
FIGS. 4*a* to 4*e* show the device part according to FIGS. 2 and 3 in different views, where
Figure 4B:
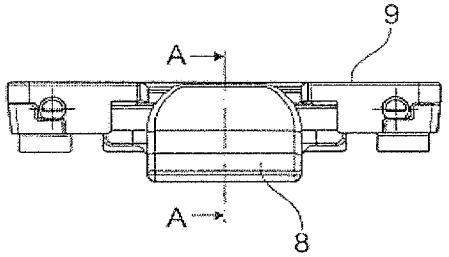
Figure 4C:
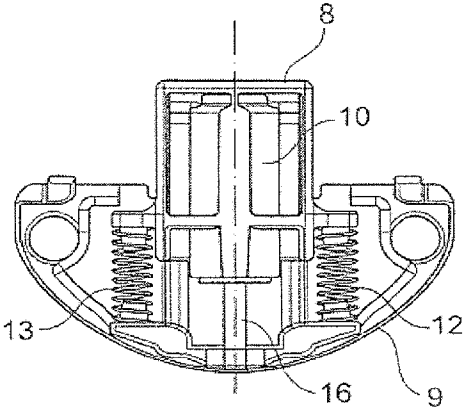
Figure 4E:
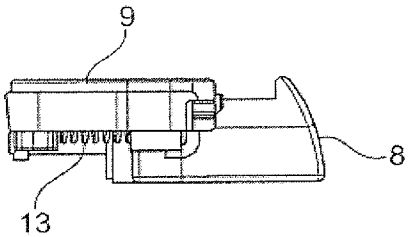
Figure 4D:
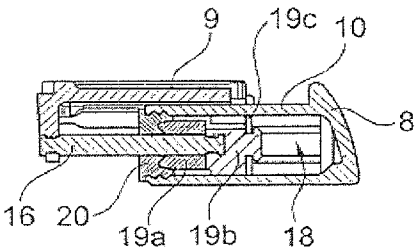
Figure 4F:
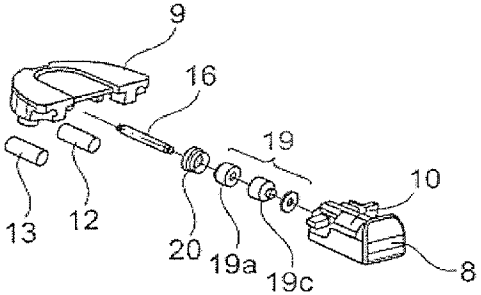
FIG. 4*f* an exploded illustration of the device part according to FIGS. 4*a* to 4*e;*

FIGS. 4*d* and 4*f* show, in particular, the parts of the inner part 19 which is accommodated in an inner volume 18 of the damper housing 8 and which is composed of the individual elements 19*a*, 19*b* and 19*c*. The inner volume 18 of the damper housing 8 is sealingly closed outwardly by means of a closing cover 20, through which the piston rod 16 is slidably led, sealed off.

Figure 5:
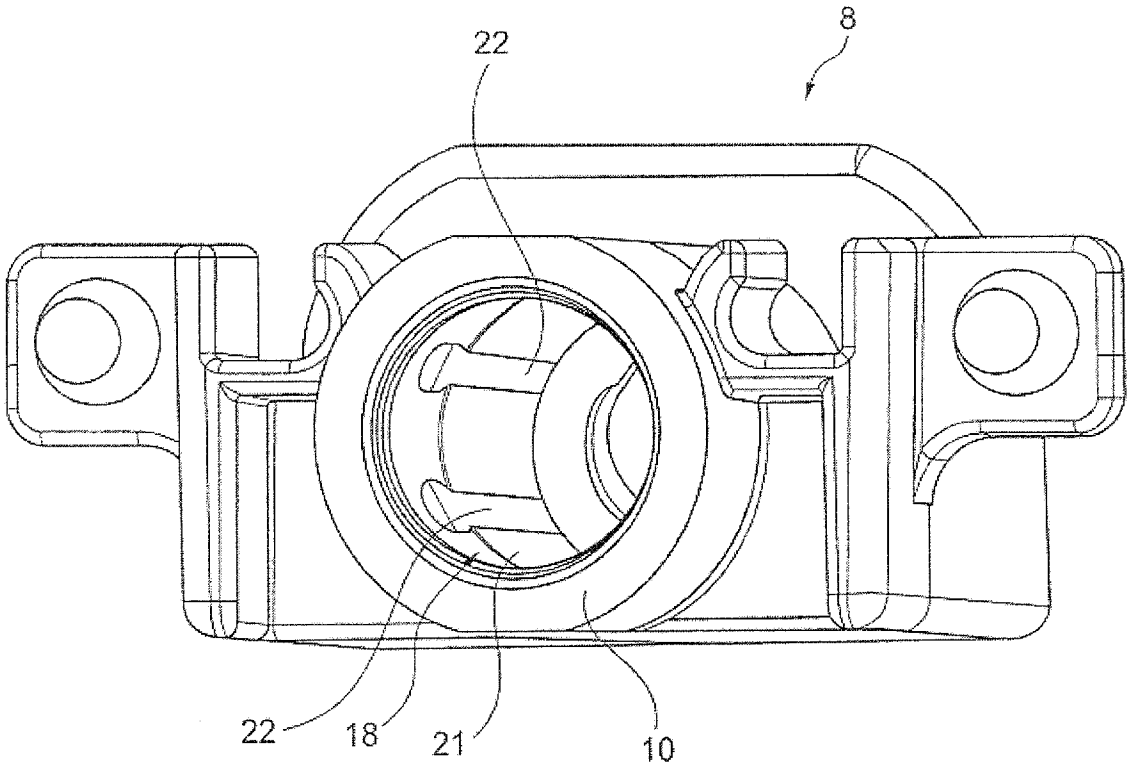
FIG. 5 shows a perspective view of part of the device part according to FIGS. 4*a* to 4*f;*

FIG. 5 shows the damper housing 8 alone in perspective, from a side directed toward the baseplate 9 in the assembled state of the damping device 6, with an open inner volume 18 which accommodates a damper fluid and in which the inner part 19 is accommodated displaceably. The inner volume 18 of the damper cylinder 10 has essentially a hollow-cylindrical basic shape and is surrounded by an inner wall or by wall portions delimiting the inner volume 18. The inner wall 21 is essentially cylindrical, guide means portions, which are designed here as guide ribs 22, projecting in regions into the cylindrical basic shape. According to FIG. 5, for example, two guide ribs 22 are evident, at least two further corresponding guide ribs being present on that side of the inner wall 21 which cannot be seen in FIG. 5 and which lies opposite the visible side.

The guide ribs 22 extend over virtually the entire length of the inner volume 18 of the damper cylinder 10 and, in particular, over an entire possible displacement length of the relative movement between the inner part 19 and the inner wall 21, so that, over the entire to-and-fro movement of the damper housing 8, since the inner part 19 does not move on the damping device 6 in the case shown, guidance of movement is implemented by the guide ribs 22 bearing against the outside or against counterportions of the inner part 19. Reverse kinematics are also equivalently possible, according to which the guide ribs are stationary and an inner part is guided past them. According to alternative exemplary embodiments of the invention, superposition of movement by the simultaneous movement of guide ribs and the inner part is also not ruled out.

The guide ribs 22 are designed here to be strip-shaped continuously over the length of the inner wall 21. However, basically, other shapes, deviating where appropriate from the strip shape, of the guide ribs 22 or of the guide means portions, or, for example, interrupted guide ribs or, for example, a plurality of guide elevations projecting in a punctiform manner are also possible.

Figure 6B:
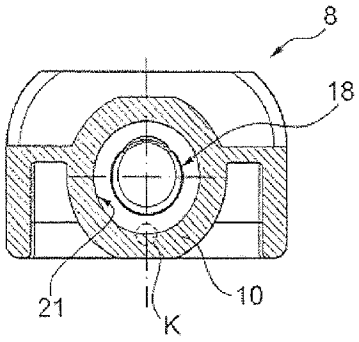
FIG. 6*b* shows a sectional view through the arrangement according to FIG. 6*a* along the line B-B.
Figure 6A:
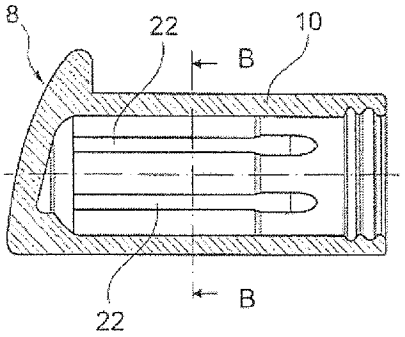
FIG. 6*a* shows the part according to FIG. 5 in a central longitudinal section.
Figure 6C:
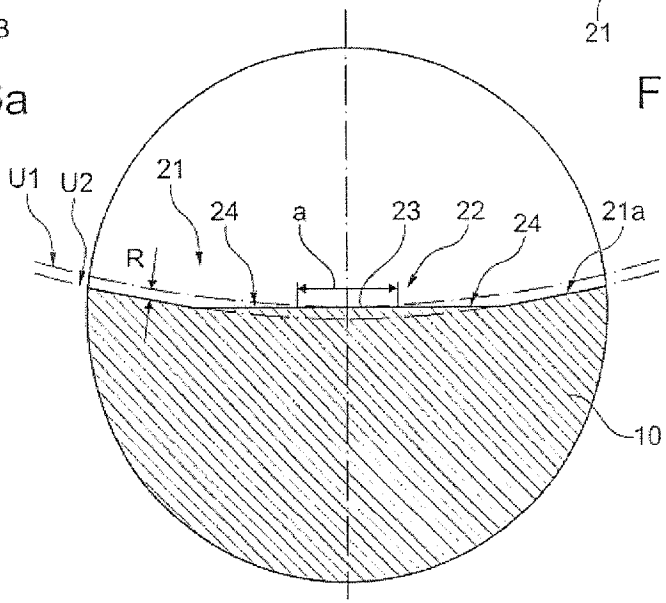
FIG. 6*c* shows an enlarged view, in the form of a detail, of the round region designated in FIG. 6*b* by K.

FIGS. 6*a* to 6*c* illustrate the inner volume 18 and the type of guide ribs 22 in more detail. In this case, FIG. 6*a* shows the damper housing 8 with the damper cylinder 10 in longitudinal section. Two guide ribs 22 according to the illustration from FIG. 5 are likewise evident. FIG. 6*b* shows, in a cross section through the damper housing 8, the region corresponding to the portion K which is bordered by a circle and which is illustrated, enlarged, in FIG. 6*c*. In this case, the inner wall 21, which is of essentially hollow-cylindrical design, is shown in the region of a guide rib 22 in a section transverse to the longitudinal extent of the damper housing 8 or damper cylinder 10. The guide rib 22 is, for example, essentially trapezoidal here and projects from a hollow-cylindrical inner wall portion or from a main surface 21*a* of the inner wall 21 slightly, for example by a fraction of a millimeter, into the inner volume 18 in an elevated manner. In this case, the guide rib 22 has an essentially planar sliding portion 23 which is delimited on the outside or on both sides by obliquely descending flanks 24 and which on both sides connects the sliding portion 23 to the main surface 21*a* of the inner wall 21. The individual element 19*b* or the inner part 19 can be guided centrically via the, for example, four guide ribs 22 on the inner wall 21 of the inner volume 18, in that, during a relative movement under consideration, the outside of the individual element 19*b* slides along the sliding portions 23, at the same time touching them. In this case, an angular gap R, constant in the circumferential direction and in the axial direction, is formed between a circumferential line U2, on which the main surface 21 a lies, and a circumferential line U1, on which the sliding portion 23 lies. During movement of the damper housing 8, damper fluid, for example air or oil, flows via the annular gap R from a first subvolume into a second subvolume and back again, this affording the actual damping action, the two subvolumes of variable size being formed in the inner volume 18 in each case axially on both sides of the inner element 19.

In the assembled state of the damping device 6, the cylindrical outer wall of the individual element 19*b* is delimited by the circumferential line U1 (see FIG. 6*c*), so that the outer wall of the individual element 19*b* and the sliding portion 23 come into sealing bearing contact with one another for movement guidance.

The sliding portion 23 is designed to be strip-shaped along the inner volume 18 over a circumferential width a according to FIG. 6*c*. The outside of the individual element 19*b* is guided over the thereby provided approximately rectangular surface region of the sliding portion 23 or a linear region on the latter. The sliding portion 23 is preferably planar, as shown, or, for example, is curved slightly concavely, in particular, correspondingly to the circumferential line U1.

List of Reference Symbols:

1 Hinge arm
2 Hinge pot
3 Fastening flange
3a, 3b Screw
4 Inner wall
5 Projection
6 Damping device
7 Bearing point
8 Damper housing
9 Baseplate
10 Damper cylinder
11 Guide web
12, 13 Spring
14 Nose
15 Stop
16 Piston rod
17 Piston rod fixing
18 Inner volume
19 Inner part
19a-19c Individual element
20 Closing cover
21 Inner wall
21a Main surface
22 Guide rib
23 Sliding portion
24 Flank

The invention claimed is:

1. A damping device for damping a relative movement of device parts of a device for pivoting and/or displacing a furniture part guided movably on a furniture body, the damping device comprising a damper housing with an inner volume and an inner part accommodated in the inner volume, the damper housing and the inner part executing a relative movement during a damping action, so that, during the relative movement, wall portions of said housing delimiting the inner volume and an at least essentially cylindrical portion of the inner part can be moved past and opposite one another, wherein the wall portions have an essentially hollow-cylindrical basic shape, and guide means portions projecting into the hollow-cylindrical basic shape, wherein the guide means portions are in bearing contact against the cylindrical portion of the inner part during the relative movement, and wherein the guide means portions have at least two elevations which are positioned at least approximately opposite one another and the guide means portions extend in a direction of relative movement over an entire displacement length of the relative movement.

2. The damping device according to claim 1, wherein the wall portions have an essentially polygonal basic shape, the guide means portions formed between corners of the polygonal basic shape and being in bearing contact against the at east essentially cylindrical portion of the inner part during the relative movement.

3. The damping device according to claim 2, wherein the wall portions have an essentially regular polygonal shape.

4. The damping device according to claim 1, wherein the guide means portions are present circumferentially in at least two locations on the essentially hollow-cylindrical basic shape.

5. The damping device according to claim 4, wherein the guide means portions have at least two elevations running in the longitudinal direction of the essentially hollow-cylindrical basic shape.

6. The damping device according claim 4, wherein the guide means portions have two elevations which are positioned approximately opposite to one another in the inner volume.

7. The damping device according to claim 4, wherein a plurality of guide means portions are uniformly spaced apart from one another circumferentially on the essentially hollow-cylindrical basic shape.

8. The damping device according to claim 4, wherein the guide means portions have a plurality of elevations with respect to a longitudinal axis of the essentially hollow-cylindrical basic shape.

9. The damping device according to claim 1, wherein the guide means portions have at least two opposite sliding portions, against which the inner part is slidably in bearing contact during the relative movement.

10. The damping device according to claim 1, wherein the guide means portions have, in a section transverse to the longitudinal axis of the essentially hollow-cylindrical basic shape, oblique flanks with a sliding portion lying between them.

11. The damping device according to claim 10, wherein the sliding portion is of essentially planar configuration.

12. A furniture hinge having a device according to claim 1.

13. A furniture with a body and with a movable furniture part that is one of a door or flap, that is fastened to the body, wherein a furniture hinge according to claim 12 is provided.

* * * * *